US008088270B2

(12) United States Patent
Gordon et al.

(10) Patent No.: US 8,088,270 B2
(45) Date of Patent: Jan. 3, 2012

(54) PROCESS FOR RECOVERING ALKALI METALS AND SULFUR FROM ALKALI METAL SULFIDES AND POLYSULFIDES

(75) Inventors: John Howard Gordon, Salt Lake City, UT (US); Ashok V. Joshi, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 637 days.

(21) Appl. No.: 12/277,822

(22) Filed: Nov. 25, 2008

(65) Prior Publication Data

US 2009/0134040 A1 May 28, 2009

Related U.S. Application Data

(60) Provisional application No. 60/990,579, filed on Nov. 27, 2007, provisional application No. 61/103,973, filed on Oct. 9, 2008.

(51) Int. Cl.
*C25C 1/02* (2006.01)

(52) U.S. Cl. ..... 205/560; 204/263

(58) Field of Classification Search ..... None
See application file for complete search history.

(56) References Cited

U.S. PATENT DOCUMENTS

| | | | | |
|---|---|---|---|---|
| 1,501,756 | A | 7/1924 | Downs | |
| 3,660,170 | A | 5/1972 | Rampel | |
| 3,785,965 | A | 1/1974 | Welty | |
| 3,787,315 | A | 1/1974 | Bearden, Jr. et al. | |
| 3,788,978 | A | 1/1974 | Bearden, Jr. et al. | |
| 3,791,966 | A | 2/1974 | Bearden | |
| 3,930,969 | A * | 1/1976 | Chen | 205/574 |
| 3,970,472 | A | 7/1976 | Steffensen | |
| 4,053,371 | A | 10/1977 | Towsley et al. | |
| 4,076,613 | A | 2/1978 | Bearden, Jr. | |
| 4,097,345 | A * | 6/1978 | Shannon | 205/560 |

(Continued)

FOREIGN PATENT DOCUMENTS

JP 08321322 A 12/1996

(Continued)

OTHER PUBLICATIONS

Kim, "International Search Report", International App. No. PCT/US2008/084707, (Apr. 29, 2009),1-3.

(Continued)

*Primary Examiner* — Harry D Wilkins, III
(74) *Attorney, Agent, or Firm* — David Fonda

(57) ABSTRACT

Alkali metals and sulfur may be recovered from alkali polysulfides in an electrolytic process that utilizes an electrolytic cell having an alkali ion conductive membrane. An anolyte solution includes an alkali polysulfide and a solvent that dissolves elemental sulfur. A catholyte solution includes alkali metal ions and a catholyte solvent. Applying an electric current oxidizes sulfur in the anolyte compartment, causes alkali metal ions to pass through the alkali ion conductive membrane to the catholyte compartment, and reduces the alkali metal ions in the catholyte compartment. Sulfur is recovered by removing and cooling a portion of the anolyte solution to precipitate solid phase sulfur. Operating the cell at low temperature causes elemental alkali metal to plate onto the cathode. The cathode may be removed to recover the alkali metal in batch mode or configured as a flexible band to continuously loop outside the catholyte compartment to remove the alkali metal.

30 Claims, 4 Drawing Sheets

U.S. PATENT DOCUMENTS 4,191,620 A * 3/1980 Young et al. ..... 95/179
4,204,922 A * 5/1980 Fraser et al. ..... 205/352
4,207,391 A 6/1980 Church et al.
4,298,666 A 11/1981 Taskier
4,307,164 A 12/1981 Church et al.
4,372,823 A 2/1983 Church et al.
4,465,744 A 8/1984 Susman et al.
4,479,856 A 10/1984 Ando
4,542,444 A 9/1985 Boland
4,546,055 A 10/1985 Coetzer et al.
4,623,597 A 11/1986 Sapru et al.
4,772,366 A * 9/1988 Winnick ..... 205/617
4,842,963 A 6/1989 Ross, Jr. et al.
5,057,206 A 10/1991 Engel et al.
5,213,908 A 5/1993 Hagedorn
5,290,405 A 3/1994 Joshi et al.
5,342,709 A 8/1994 Yahnke et al.
5,391,267 A * 2/1995 Zoppi ..... 205/510
5,516,598 A 5/1996 Visco et al.
5,525,442 A 6/1996 Shuster
5,541,019 A 7/1996 Anani et al.
5,578,189 A * 11/1996 Joshi ..... 205/341
5,580,430 A 12/1996 Balagopal et al.
5,695,632 A 12/1997 Brons et al.
5,780,186 A 7/1998 Casey, Jr.
5,856,047 A 1/1999 Venkatesan et al.
5,882,812 A 3/1999 Visco et al.
5,935,421 A 8/1999 Brons et al.
6,017,651 A 1/2000 Nimon et al.
6,025,094 A 2/2000 Visco et al.
6,030,720 A 2/2000 Chu et al.
6,110,236 A 8/2000 Tsang et al.
6,153,328 A 11/2000 Colborn
6,159,634 A 12/2000 Yen et al.
6,165,644 A 12/2000 Nimon et al.
6,200,704 B1 3/2001 Katz et al.
6,210,564 B1 4/2001 Brons et al.
6,210,832 B1 4/2001 Visco et al.
6,214,061 B1 4/2001 Visco et al.
6,225,002 B1 5/2001 Nimon et al.
6,248,476 B1 6/2001 Sun et al.
6,248,481 B1 6/2001 Visco et al.
6,265,100 B1 7/2001 Saaski et al.
6,291,090 B1 9/2001 Kuznetsov et al.
6,310,960 B1 10/2001 Saaski et al.
6,355,379 B1 3/2002 Ohshita et al.
6,358,643 B1 3/2002 Katz et al.
6,368,486 B1 4/2002 Thompson et al.
6,376,123 B1 4/2002 Chu
6,402,795 B1 6/2002 Chu et al.
6,413,284 B1 7/2002 Chu et al.
6,413,285 B1 7/2002 Chu et al.
6,416,903 B1 7/2002 Fierro et al.
6,432,584 B1 8/2002 Visco et al.
6,537,701 B1 3/2003 Nimon et al.
6,610,440 B1 8/2003 LaFollette et al.
6,632,573 B1 10/2003 Nimon et al.
6,737,197 B2 5/2004 Chu et al.
6,787,019 B2 9/2004 Jacobson et al.
6,852,450 B2 2/2005 Hwang et al.
6,881,234 B2 4/2005 Towsley
6,911,280 B1 6/2005 De Jonghe et al.
6,955,753 B1 10/2005 Gomez
6,955,866 B2 10/2005 Nimon et al.
6,991,662 B2 1/2006 Visco et al.
7,070,632 B1 7/2006 Visco et al.
7,144,654 B2 12/2006 LaFollette et al.
7,166,384 B2 1/2007 LaFollette et al.
7,214,443 B2 5/2007 Clarke et al.
7,259,126 B2 8/2007 Gordon et al.
7,282,295 B2 10/2007 Visco et al.
7,282,296 B2 10/2007 Visco et al.
7,282,302 B2 10/2007 Visco et al.
7,390,591 B2 6/2008 Visco et al.
7,432,017 B2 10/2008 Visco et al.
7,482,096 B2 1/2009 De Jonghe et al.
7,491,458 B2 2/2009 Visco et al.
2002/0150818 A1 10/2002 Amatucci et al.
2004/0197641 A1 10/2004 Visco et al.
2004/0229107 A1 11/2004 Smedley
2005/0109617 A1 5/2005 Ono et al.
2005/0175894 A1 8/2005 Visco et al.
2006/0096893 A1 5/2006 De Almeida et al.
2006/0141346 A1 6/2006 Gordon et al.
2006/0177732 A1 8/2006 Visco et al.
2006/0257734 A1 11/2006 Obata et al.
2007/0048610 A1 3/2007 Tsang et al.
2007/0172739 A1 7/2007 Visco et al.
2007/0221265 A1 9/2007 Affinito et al.
2007/0259235 A1 11/2007 Jacobson et al.
2008/0268327 A1 10/2008 Gordon et al.
2009/0061288 A1 3/2009 Gordon et al.
2009/0134842 A1 5/2009 Joshi et al.
2009/0136830 A1 5/2009 Gordon
2010/0089762 A1 * 4/2010 Gordon ..... 205/554
2010/0285372 A1 11/2010 Lee et al.

FOREIGN PATENT DOCUMENTS

WO WO2005038953 4/2005

OTHER PUBLICATIONS

Kim, "Written Opinion of the International Searching Authority", International App. No. PCT/US2008/084707, (Apr. 29, 2009),1-4.

Goodenough, J.B. et al., "Fast Na+ -Ion Transport in Skeleton Structures", *Mat. Res. Bull.*, vol. 11, Pergamon Press, Inc. Printed in the United States, (1976),203-220.

Hong, H.Y-P. et al., "Crystal Structures and Crystal Chemistry in the System Na1+xZr2SixP3−x012", *Mat. Res. Bull.*, vol. 11, 1976. Pergamon Press, Inc. Printed in the United States.,(1976), 173-186.

Bentzen, J. J., et al., "The preparation and characterization of dense, highly conductive Na5GdSi4O12 nasicon (NGS)", *Materials Research Bulletin*, vol. 15,(1980),1737-1745.

Delmas, C. et al., "Crystal chemistry of the Na1+xZr2−xLx(PO4)3 (L = Cr, In, Yb) solid solutions", *Materials Research Bulletin*, vol. 16,(1981),285-290.

Von Alpen, V. et al., "Compositional dependence of the electrochemical and structural parameters in the NASICON system (Na1+xSixZr2P3−xO12)", *Solid State Ionics*, vol. 3/4,(1981),215-218.

Fujitsu, S. et al., "Conduction paths in sintered ionic conductive material Na1+xYxZr2−x(PO4)3", *Materials Research Bulletin*, vol. 16,(1981),1299-1309.

Saito, Y. et al., "Ionic Conductivity of NASICON-type conductors Na1.5M0.5Zr1.5(PO4)3 (M: Al3+, Ga3+, Cr3+, Sc3+, Fe3+, In3+, Yb3+, Y3+)", *Solid State Ionics*, vol. 58,(1992),327-331.

Alamo, J. "Chemistry and properties of solids with the [NZP] skeleton", *Solid State Ionics*, vol. 63-65,(1993),547-561.

Shimazu, K. et al., "Electrical conductivity and Ti4+ ion substitution range in NASICON system", *Solid State Ionics*, vol. 79, (1995),106-110.

Miyajima, Y. et al., "Ionic conductivity of NASICON-type Na1+xMxZr2−xP3O12(M: Yb, Er, Dy)", *Solid State Ionics*, vol. 84,(1996),61-64.

Manickam, Minakshi et al., "Lithium insertion into manganese dioxide electrode in MnO2/Zn aqueous battery Part I. A preliminary study", *Journal of Power Sources*, vol. 130, Issues 1-2 (Obtained through ScienceDirect),(May 2004),254-259.

Sumathipala, et al., "Novel Li+ Ion Conductors and Mixed Conductors, Li3+xSixCr1−xO4 and a Simple Method for Estimating Li+/e− Transport Numbers", *J. Electrochem. Soc.*, vol. 142, No. 7,(Jul. 1995),2138-2143.

Kowalczk, et al., "Li-air batteries: A classic example of limitations owing to solubilities", *Pure Appl. Chem.*, vol. 79, No. 5,(2007),851-860.

Read, "Characterization of the Lithium/Oxygen Organic Electrolyte Battery", *J. Electrochem. Soc.*, vol. 149, No. 9,(2002),A1190-A1195.

Panero, et al., "High Voltage Lithium Polymer Cells Using a PAN-Based Composite Electrolyte", *J. Electrochem. Soc.*, vol. 149, No. 4,(2002),A414-A417.

Dissanayake, et al., "Lithium ion conducting Li4-2xGe1-xSxO4 solid electrolytes", *Solid State Ionics*, 62,(1993),217-223.

Balagopal, et al., "Selective sodium removal from aqueous waste streams with NaSICON ceramics", *Separation and Purification Technology*, 15,(1999),231-237.
Sagane, et al., "Li+ and Na+ transfer through interfaces between inorganic solid electrolytes and polymer or liquid electrolytes", *Journal of Power Sources*, 146,(2005),749-752.
Wang, et al., "LiTi2(PO4)3 with NASICON-type structure as lithium-storage materials", *Journal of Power Sources*, 124,(2003),231-236.
Dissanayake, et al., "New solid electrolytes and mixed conductors: Li3+xCr1−xMxO4: M = Ge, Ti", *Solid State Ionics*, 76,(1995),215-220.
Kerr, "Polymeric Electrolytes: An Overview", *Lithium Batteries: Science and Technology*, Chapter 19, edited by Nazri and Pistoia, Kluwer Academic Publishers,(2004),574-622.
Young, Lee W., "International Search Report", PCT Search Report for App. No. PCT/US07/21978, (Oct. 10, 2008), 1-2.
Young, Lee W., "Written Opinion of the International Searching Authority", PCT Written Opinion for App. No. PCT/US07/21978, (Oct. 10, 2008),1-5.
Young, Lee W., "International Search Report", PCT Search Report for App. No. PCT/US 08/10435, (Nov. 25, 2008), 1-2.
Young, Lee W., "Written Opinion of the International Searching Authority", PCT Written Opinion for App. No. PCT/US08/10435, (Nov. 25, 2008),1-4.
Fu, "Effects of M3+ Ions on the Conductivity of Glasses and Glass-ceramics in the system Li2O-M2O3-GeO2-P2O5 (M = Al, Ga, Y, Dt, Gd, and La)", *Communications of the American Ceramic Society*, vol. 83, No. 4, (Apr. 2000), 104-106.
Thokchom, et al., "Superionic Conductivity in a Lithium Aluminum Germanium Phosphate Glass-Ceramic", *Journal of the Electrochemical Society*, 155 (12), (Oct. 8, 2008),A915-A920.
Fu, "Fast Li+ Ion Conducting Glass Ceramics in the System Li2O-Al2O3-TiO2-P2O5", *Science Direct, Solid State Ionics*, Vol. 104, Issues 3-4, (Dec. 11, 1997), 191-194.
Saienga, et al., "The Comparative Structure, Property, and Ionic Conductivity of LiI + Li2S + GeS2 Glasses Doped with Ga2S3 and La2S3", *Journal of Non-Crystalline Solids*, vol. 354, 14, (Mar. 1, 2008),Abstract.
Wang, et al., "Polymer Composite Electrolytes Containing Active Mesoporous SiO2 Particles", *Journal of Applied Physics*, 102, (2007),1-6.
Wang, et al., "Li1.3Al0.3Ti1.7(PO4)3 Filler Effect on (PEO)LiCIO4 Solid Polymer Electrode", *Department of Materials Science and Engineering, Zhejiang University*, (2004),Abstract.
Park, Jin "Written Opinion of the International Searching Authority Mailed on Jun. 30, 2009", Int. App. No. PCT/US2008/084572, 1-3.
Park, Jin "International Search Report Mailed on Jun. 30, 2009", Int. App. No. PCT/US2008/084572, 1-3.
Kim, Jun Hak "Written Opinion of the International Searching Authority Mailed on Aug. 24, 2009", Int. App. No. PCT/US2009/032458, 1-4.
Kim, Jun Hak "International Search Report Mailed on Aug. 24, 2009", Int. App. No.PCT/US2009/032458, 1-3.
Apicella, Karie O., "Office Action for U.S. Appl. No. 12/323,165", (Jun. 1, 2011),1-10.
Armand, Michel et al., "ionic-liquid materials for the electrochemical challenges of the future", *Nature Materials*, (Jul. 24, 2009),621-629.
Cantelmo, Gregg "Office Action for U.S. Appl. No. 11/944,719", (Dec. 27, 2010),1-8.
Cullen, Sean P., "Office Action for U.S. Appl. No. 12/205,759", (Apr. 13, 2011),1-15.
Cullen, Sean P., "Office Action for U.S. Appl. No. 12/205,759", (Sep. 16, 2010),1-22.
Doyle, Kevin P., et al., "Dentrite-Free Electrochemical Deposition of Li—Na Alloys from an Ionic Liquid Electrolyte", *Journal of the Electrochemical Society*, (May 2006),A1353-A1357.
IPDL Machine Translation of JP08-321322A, 1-10, Dec. 1996.
Kalafut, Stephen J., "Office Action for U.S. Appl. No. 11/871,824", (Dec. 10, 2010),1-7.
Kalafut, Stephen J., "Office Action for U.S. Appl. No. 11/871,824", (May 25, 2010),1-8.
Kim, K et al., "Electrochemical Investigation of Quaternary Ammonium/Aluminum Chloride Ionic Liquids", *Journal of The Electrochemical Society*, (Jun. 2004),A1168-A1172.
Kim, Ketack et al., "The Role of Additives in the Electroreduction of Sodium Ions in Chloroaluminate-Based Ionic Liquids", *Journal of the Electrochemical Society*, (Dec. 2004),E9-E13.
Kim, Yeon-Gyeong "PCT International Search Report", Int. App. No. PCT/US2009/056781, (Mar. 2, 2010),1-4.
Kim, Yeon-Gyeong "PCT Written Opinion", Int. App. No. PCT/US2009/056781, (Mar. 2, 2010),1-3.
Lang, Christopher M., et al., "Cation Electrochemical Stability in Chloroaluminate Ionic Liquids", *J. Phys. Chem.*, (2005),19454-19462.
Parsons, Thomas H., "Office Action for U.S. Appl. No. 12/022,381", (May 24, 2011),1-11.
Salminen, Justin et al., "Ionic liquids for rechargeable lithium batteries", *Lawrence Berkeley National Laboratory*, (Sep. 21),1-19, 2008.
Wu, Xian Ming et al., "Preparation and characterization of lithium-ion-conductive Li(1.3)Al(0.3)Ti(1.7)(PO4)3 thin films by the solution deposition", *Thin Solid Films 425*, (2003),103-107.
Lee, Kang Young "International Search Report", International App. No. PCT/US2010/055718, (Jun. 21, 2011),1-3.
Lee, Kang Young "Written Opinion", International App. No. PCT/US2010/055718, (Jun. 21, 2011),1-3.

* cited by examiner

PROCESS FOR RECOVERING ALKALI METALS AND SULFUR FROM ALKALI METAL SULFIDES AND POLYSULFIDES

CROSS-REFERENCE TO RELATED APPLICATION

This application claims the benefit of U.S. Provisional Patent Application Nos. 60/990,579, filed Nov. 27, 2007, and 61/103,973, filed Oct. 9, 2008, which are incorporated by reference.

FIELD OF THE INVENTION

The present invention relates to a process for removing nitrogen, sulfur, and heavy metals from sulfur-, nitrogen-, and metal-bearing shale oil, bitumen, or heavy oil. More particularly, the invention relates to a method of regenerating alkali metals from sulfides and polysulfides of those metals. The invention further relates to the removal and recovery of sulfur from alkali metal sulfides and polysulfides.

BACKGROUND OF THE INVENTION

The demand for energy and the hydrocarbons from which that energy is derived is continually rising. The hydrocarbon raw materials used to provide this energy, however, contain difficult to remove sulfur and metals that hinder their usage. Sulfur can cause air pollution, and can poison catalysts designed to remove hydrocarbons and nitrogen oxide from motor vehicle exhaust. Similarly, other metals contained in the hydrocarbon stream can poison catalysts typically utilized for removal of sulfur through standard and improved hydrodesulfurization processes whereby hydrogen reacts under extreme conditions to break down the sulfur bearing organosulfur molecules.

Extensive reserves of shale oil exist in the U.S. that will increasingly play a role in meeting U.S. energy needs. Over 1 trillion barrels reserves lay in a relatively small area known as the Green River Formation located in Colorado, Utah, and Wyoming. As the price of crude oil rises, the resource becomes more attractive but technical issues remain to be solved. A key issue is addressing the relatively high level of nitrogen contained in the shale oil chemistry after retorting as well as addressing sulfur and metals content.

Shale oil characteristically is high in nitrogen, sulfur, and heavy metals which makes subsequent hydrotreating difficult. According to America's Strategic Unconventional Fuels, Vol. III—Resource and Technology Profiles, p. 111-25, nitrogen is typically around 2% and sulfur around 1% along with some metals in shale oil. Heavy metals contained in shale oil pose a large problem to upgraders. Sulfur and nitrogen typically are removed through treating with hydrogen at elevated temperature and pressure over catalysts such as Co—Mo/$Al_2O_3$ or Ni—Mo/$Al_2O_3$. These catalysts are deactivated as the metals mask the catalysts.

Another example of a source of hydrocarbon fuel where the removal of sulfur poses a problem is in bitumen existing in ample quantities in Alberta, Canada and heavy oils such as in Venezuela. In order to remove sufficient sulfur from the bitumen for it to be useful as an energy resource, excessive hydrogen must be introduced under extreme conditions, which creates an inefficient and economically undesirable process.

Over the last several years, sodium has been recognized as being effective for the treatment of high-sulfur petroleum oil distillate, crude, heavy oil, bitumen, and shale oil. Sodium is capable of reacting with the oil and its contaminants to dramatically reduce the sulfur, nitrogen, and metal content through the formation of sodium sulfide compounds (sulfide, polysulfide and hydrosulfide). Examples of the processes can be seen in U.S. Pat. Nos. 3,785,965; 3,787,315; 3,788,978; 4,076,613; 5,695,632; 5,935,421; and 6,210,564.

An alkali metal such as sodium or lithium is reacted with the oil at about 400° C. and 300-2000 psi. For example 1-2 moles sodium and 1-1.5 moles hydrogen may be needed per mole sulfur according to the following initial reaction with the alkali metal:

$$R—S—R'+2Na+H_2 \rightarrow R—H+R'—H+Na_2S$$

$$R,R',R''—N+3Na+1.5H_2 \rightarrow R—H+R'—H+R''—H+Na_3N$$

Where R, R', R'' represent portions of organic molecules or organic rings.

The sodium sulfide and sodium nitride products of the foregoing reactions may be further reacted with hydrogen sulfide according to the following reactions:

$$Na_2S+H_2S \rightarrow 2NaHS \text{ (liquid at 375° C.)}$$

$$Na_3N+3H_2S \rightarrow 3NaHS+NH_3$$

The nitrogen is removed in the form of ammonia which may be vented and recovered. The sulfur is removed in the form of an alkali hydrosulfide, NaHS, which is separated for further processing. The heavy metals and organic phase may be separated by gravimetric separation techniques. The above reactions are expressed using sodium but may be substituted with lithium.

Heavy metals contained in organometallic molecules such as complex porphyrins are reduced to the metallic state by the alkali metal. Once the heavy metals have been reduced, they can be separated from the oil because they no longer are chemically bonded to the organic structure. In addition, once the metals are removed from the porphyrin structure, the nitrogen heteroatoms in the structure are exposed for further denitrogenation.

The following is a non-limiting description of the foregoing process of using alkali metals to treat the petroleum organics. Liquid phase alkali metal is brought into contact with the organic molecules containing heteroatoms and metals in the presence of hydrogen. The free energy of reaction with sulfur and nitrogen and metals is stronger with alkali metals than with hydrogen so the reaction more readily occurs without full saturation of the organics with hydrogen. Hydrogen is needed in the reaction to fill in the where heteroatoms and metals are removed to prevent coking. Once the alkali metal compounds are formed and heavy metals are reduced to the metallic state, it is necessary to separate them. This is accomplished by a washing step, either with steam or with hydrogen sulfide to form a hydroxide phase if steam is utilized or a hydrosulfide phase if hydrogen sulfide is used. At the same time alkali nitride is presumed to react to form ammonia and more alkali hydroxide or hydrosulfide. A gravimetric separation such as centrifugation or filtering can separate the organic, upgraded oil, from the salt phase.

In conventional hydrotreating, instead of forming $Na_2S$ to desulfurize, or forming $Na_3N$ to denitrogenate, $H_2S$ and $NH_3$ are formed respectively. The reaction to form hydrogen sulfide and ammonia is much less favorable thermodynamically than the formation of the sodium or lithium compounds so the parent molecules must be destabilized to a greater degree for the desulfurization of denitrogenation reaction to proceed. According to T. Kabe, A Ishihara, W. Qian, in *Hydrodesulfurization and Hydrodenitrogenation*, pp. 37, 110-112, Wiley-VCH, 1999, this destabilization occurs after the benzo rings are mostly saturated. To provide this saturation of the rings, more hydrogen is required for the desulfurization and denitrogenation reactions and more severe conditions are required to achieve the same levels of sulfur and nitrogen removal compared to removal with sodium or lithium. As mentioned above, desulfurizing or denitrogenating using hydrogen without sodium or lithium is further complicated with the masking of catalyst surfaces from precipitating heavy metals and coke. Since the sodium is in the liquid phase, it can more easily access the sulfur, nitrogen and metals where reaction is desirable.

Once the alkali metal sulfide has been separated from the oil, sulfur and metals are substantially removed, and nitrogen is moderately removed. Also, both viscosity and density are reduced (API gravity is increased). Bitumen or heavy oil would be considered synthetic crude oil (SCO) and can be shipped via pipeline for further refining. Similarly, shale oil will have been considerably upgraded after such processing. Subsequent refining will be easier since the troublesome metals have been removed.

Although the effectiveness of the use of alkali metals such as sodium in the removal of sulfur has been demonstrated, the process is not commercially practiced because a practical, cost-effective method to regenerate the alkali metal has not yet heretofore been proposed. Several researchers have proposed the regeneration of sodium using an electrolytic cell, which uses a sodium-ion-conductive beta-alumina membrane. Beta-alumina, however, is both expensive and fragile, and no significant metal production utilizes beta-alumina as a membrane separator. Further, the cell utilizes a sulfur anode, which results in high polarization of the cell causing excessive specific energy requirements.

Metallic sodium is commercially produced almost exclusively in a Downs-cell such as the cell described in U.S. Pat. No. 1,501,756. Such cells electrolyze sodium chloride that is dissolved in a molten salt electrolyte to form molten sodium at the cathode and chlorine gas at the anode. The cells operate at a temperature near 600° C., a temperature compatible with the electrolyte used. Unlike the sulfur anode, the chlorine anode is utilized commercially both with molten salts as in the co-production of sodium and with saline solution as in the co-production of sodium hydroxide.

Another cell technology that is capable of reducing electrolyte melting range and operation of the electrolyzer to less than 200° C. has been disclosed by Jacobsen et al. in U.S. Pat. No. 6,787,019, and Thompson et al. in U.S. Pat. No. 6,368,486. In those disclosures, low temperature co-electrolyte is utilized with the alkali halide to form a low temperature melting electrolyte.

It is an object of the present invention to provide a cost-effective and efficient method for the regeneration of alkali metals used in the desulfurization, denitrogenation, and demetallation of hydrocarbon streams. As will be described herein, the present invention is able to remove contaminants and separate out unwanted material products from desulfurization/denitrogenation/demetallation reactions, and then recover those materials for later use.

The present invention relates to a denitrogenation and desulfurization technology that is insensitive to the heavy metal content and at the same time demetallizes very effectively. The deep demetallization provides an enormous benefit because additional hydrotreating processes will not be affected by the metals originally contained in the shale oil and tar sands.

BRIEF SUMMARY OF THE INVENTION

The present invention provides a process for removing nitrogen, sulfur, and heavy metals from sulfur-, nitrogen-, and metal-bearing shale oil, bitumen, or heavy oil. The present invention further provides an electrolytic process of regenerating alkali metals from sulfides, polysulfides, nitrides, and polynitrides of those metals. The present invention further provides an electrolytic process of removing sulfur from a polysulfide solution.

One non-limiting embodiment within the scope of the invention includes a process for oxidizing alkali metal polysulfides electrochemically. The process utilizes an electrolytic cell having an alkali ion conductive membrane configured to selectively transport alkali ions, the membrane separating an anolyte compartment configured with an anode and a catholyte compartment configured with a cathode. An anolyte solution is introduced into the anolyte compartment. The anolyte solution includes an alkali metal polysulfide and an anolyte solvent that dissolves elemental sulfur. A catholyte solution is introduced into the catholyte compartment. The catholyte solution includes alkali metal ions and a catholyte solvent. The catholyte solvent may include one of many non-aqueous solvents such as tetraglyme, diglyme, dimethyl carbonate, dimethoxy ether, propylene carbonate, ethylene carbonate, diethyl carbonate. The catholyte may also include a alkali metal salt such as an iodide or chloride of the alkali metal. Applying an electric current to the electrolytic cell oxidizes sulfur in the anolyte compartment to form elemental sulfur, causes alkali metal ions to pass through the alkali ion conductive membrane from the anolyte compartment to the catholyte compartment, and reduces the alkali metal ions in the catholyte compartment to form elemental alkali metal.

Sulfur may be recovered by removing a portion of the anolyte solution from the anolyte compartment, cooling the removed anolyte solution to precipitate solid phase sulfur from the anolyte solution, separating the precipitated sulfur from the anolyte solution.

By operating the cell at a temperature below the melting temperature of the alkali metal, elemental alkali metal will plate onto the cathode. The cathode may be periodically withdrawn from the catholyte compartment to remove the alkali metal. Alternatively, in one embodiment within the scope of the invention, the cathode may be configured as a flexible band which continuously or semi-continuously loops from inside the catholyte compartment to outside the catholyte compartment and electrolytic cell housing, enabling the alkali metal to be continuously scraped or removed from the cathode.

In one non-limiting embodiment within the scope of the invention, a cell for electrolyzing an alkali metal polysulfide is provided where the cell operates at a temperature below the melting temperature of the alkali metal and where the cathode in part is in a catholyte compartment exposed to a catholyte solution containing a solvent and alkali salt, and an anode is in an anolyte compartment containing an anolyte comprising an alkali polysulfide and a solvent, where a divider separates the catholyte from the anolyte. The divider may be permeable to cations and substantially impermeable to anions, solvent and dissolved sulfur. The divider comprises in part an alkali metal conductive ceramic or glass ceramic. The alkali metal in one embodiment is either sodium or lithium.

In one non-limiting embodiment within the scope of the invention, a cell for electrolyzing an alkali metal polysulfide is provided where the cell operates at a temperature above the melting temperature of the alkali metal and where the cathode in part is immersed in a bath of the molten alkali metal with a divider between an anode compartment and a cathode compartment. In this case the catholyte essentially comprises molten metal but may also include solvent and alkali metal salt. The divider may be permeable to cations and substantially impermeable to anions, solvent and dissolved sulfur. The divider comprises in part an alkali metal conductive ceramic or glass ceramic. The divider may be conductive to ions of the class of cations which include: lithium and sodium.

In one non-limiting embodiment within the scope of the invention, a cell for electrolyzing an alkali metal polysulfide is provided where the cell operates at a temperature below the melting temperature of the alkali metal and where the cathode in part is in a catholyte bath within the cell and the cathode in part is outside the cell. The cathode within the cell can be transferred outside the cell and the cathode outside the cell can be transferred inside the cell without substantially interrupting the cell operation. The cathode may consist of a band following the path of rollers which facilitate the transfer of cathode. The alkali metal plating on the cathode, when it is inside the cell, is removed from the cathode when it is outside the cell.

In one non-limiting embodiment, a cell for electrolyzing an alkali metal polysulfide may include a divider between an anode compartment and a cathode compartment. The divider may be permeable to cations and substantially impermeable to anions, solvent and dissolved sulfur. The divider comprises in part an alkali metal conductive ceramic or glass ceramic. The divider may be conductive to ions of the class of cations which include: lithium and sodium.

In another non-limiting embodiment, a cell for electrolyzing an alkali metal polysulfide is provided with an anolyte compartment and a catholyte compartment where the anolyte solution comprises a polar solvent and dissolved alkali metal polysulfide. The anolyte solution comprises a solvent that dissolves to some extent elemental sulfur. The anolyte may comprise a solvent where one or more of the solvents includes: N,N-dimethylaniline, quinoline, tetrahydrofuran, 2-methyl tetrahydrofuran, benzene, cyclohexane, fluorobenzene, thrifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate.

In one non-limiting embodiment, a method for oxidizing polysulfides electrochemically from an anolyte solution at an anode is disclosed where the anolyte solution comprises in part an anolyte solvent that dissolves to some extent elemental sulfur. In the method, the anolyte solvent that dissolves to some extent elemental sulfur is one or more of the following: N,N-dimethylaniline, quinoline, tetrahydrofuran, 2-methyl tetrahydrofuran, benzene, cyclohexane, fluorobenzene, thrifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate.

Another non-limiting embodiment discloses a method for removal of dissolved elemental sulfur from a solvent/alkali metal polysulfide mixture includes cooling, precipitating the elemental solvent, and then separating the solid phase sulfur from the liquid phase solvent mixture. The separation of solid phase from liquid phase includes one or more of the following: gravimetric, filtration, centrifugation. The alkali metal polysulfide is of the class including sodium polysulfide and lithium polysulfide.

One non-limiting embodiment discloses a method for releasing hydrogen sulfide from an alkali metal hydrosulfide where a solvent mixture comprising a solvent and an alkali metal polysulfide is mixed with the alkali metal hydrosulfide. In this embodiment, the solvent may comprise one or more of the following: N,N-dimethylaniline, quinoline, tetrahydrofuran, 2-methyl tetrahydrofuran, benzene, cyclohexane, fluorobenzene, thrifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate. The alkali metal polysulfide is of the class including sodium polysulfide and lithium polysulfide.

One non-limiting embodiment discloses a method for releasing hydrogen sulfide from an alkali metal hydrosulfide where the hydrosulfide is mixed with sulfur. The hydrosulfide may also be mixed with sulfur and at least one solvent. The at least one solvent may comprise one or more of the following: N,N-dimethylaniline, quinoline, tetrahydrofuran, 2-methyl tetrahydrofuran, benzene, cyclohexane, fluorobenzene, thrifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate. The hydrosulfide may also be mixed with sulfur, at least one solvent, and an alkali metal polysulfide. The alkali metal may be either sodium or lithium.

The present invention may provide certain advantages, including but not limited to the following:

Operating an electrolytic cell to process an alkali metal sulfide or polysulfide at temperatures below the melting temperature of the alkali metal.

Operating an electrolytic cell continuously or semi-continuously to process an alkali metal sulfide or polysulfide at temperatures below the melting temperature of the alkali metal.

Removing an alkali metal continuously or semi-continuously in solid form from the cell.

Removing high alkali metal polysulfides and dissolved sulfur continuously or semi-continuously from the electrolytic cell.

Separating sulfur continuously or semi-continuously from a stream containing a mixture of solvent, sulfur, and alkali metal polysulfides such that the solvent and alkali metal polysulfides are substantially recovered such that they can be returned back to an electrolytic process.

Providing an apparatus and method for regenerating hydrogen sulfide from and alkali metal hydrosulfide.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the methods and cells of the present invention, as represented in FIGS. 1 through 4, is not intended to limit the scope of the invention, as claimed, but is merely representative of present embodiments of the invention.

Figure 1:
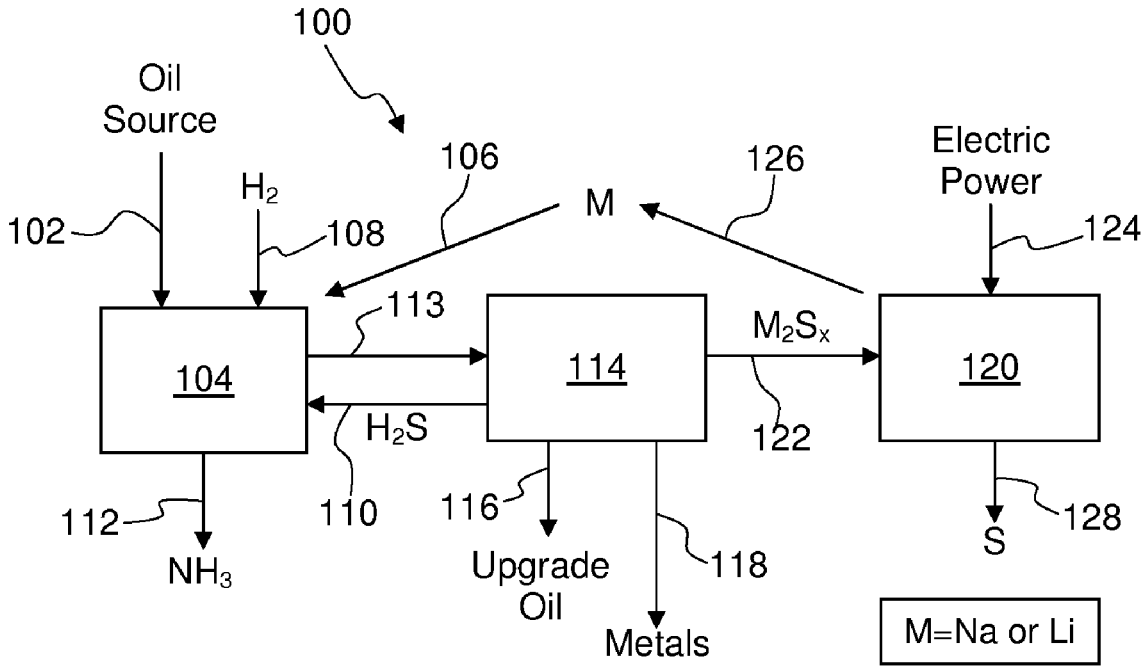
FIG. 1 shows an overall process for removing nitrogen, sulfur, and heavy metals from sulfur-, nitrogen-, and metal-bearing oil sources using an alkali metal and for regenerating the alkali metal.

The overall process is shown schematically in FIG. 1 of one non-limiting embodiment for removing nitrogen, sulfur, and heavy metals from sulfur-, nitrogen-, and metal-bearing oil sources using an alkali metal and for regenerating the alkali metal. In the process 100 of FIG. 1, an oil source 102, such as high-sulfur petroleum oil distillate, crude, heavy oil, bitumen, or shale oil, is introduced into a reaction vessel 104. An alkali metal (M) 106, such as sodium or lithium, is also introduced into the reaction vessel, together with a quantity of hydrogen 108. The alkali metal and hydrogen react with the oil and its contaminants to dramatically reduce the sulfur, nitrogen, and metal content through the formation of sodium sulfide compounds (sulfide, polysulfide and hydrosulfide) and sodium nitride compounds. Examples of the processes are known in the art, including but not limited to, U.S. Pat. Nos. 3,785,965; 3,787,315; 3,788,978; 4,076,613; 5,695,632; 5,935,421; and 6,210,564.

The alkali metal (M) and hydrogen react with the oil at about 400° C. and 300-2000 psi according to the following initial reactions:

$$R—S—R'+2M+H_2"R—H+R'—H+M_2S$$

$$R,R',R"—N+3M+1.5H_2 \rightarrow R—H+R'—H+R"—H+M_3N$$

Where R, R', R" represent portions of organic molecules or organic rings.

The sodium sulfide and sodium nitride products of the foregoing reactions may be further reacted with hydrogen sulfide 110 according to the following reactions:

$$M_2S+H_2S \rightarrow 2\ MHS\ (\text{liquid at } 375°\ C.)$$

$$M_3N+3H_2S \rightarrow 3\ MHS+NH_3$$

The nitrogen is removed in the form of ammonia 112, which may be vented and recovered. The sulfur is removed from the oil source in the form of an alkali hydrosulfide (MHS), such as sodium hydrosulfide (NaHS) or lithium hydrosulfide (LiHS). The reaction products 113, are transferred to a separation vessel 114. Within the separation vessel 114, the heavy metals 116 and upgraded oil organic phase 118 may be separated by gravimetric separation techniques.

The alkali hydrosulfide (MHS) is separated for further processing. The alkali hydrosulfide stream may be the primary source of alkali metal and sulfur from the process of the present invention. When the alkali hydrosulfide is reacted with a medium to high polysulfide (i.e. $M_2S_x$; $4 \leqq x \leqq 6$) then hydrogen sulfide will be released and the resulting mixture will have additional alkali metal and sulfide content where the sulfur to alkali metal ratio is lower. The hydrogen sulfide 110 can be used in the washing step upstream where alkali sulfide and alkali nitride and metals need to be removed from the initially treated oil.

Figure 2A:
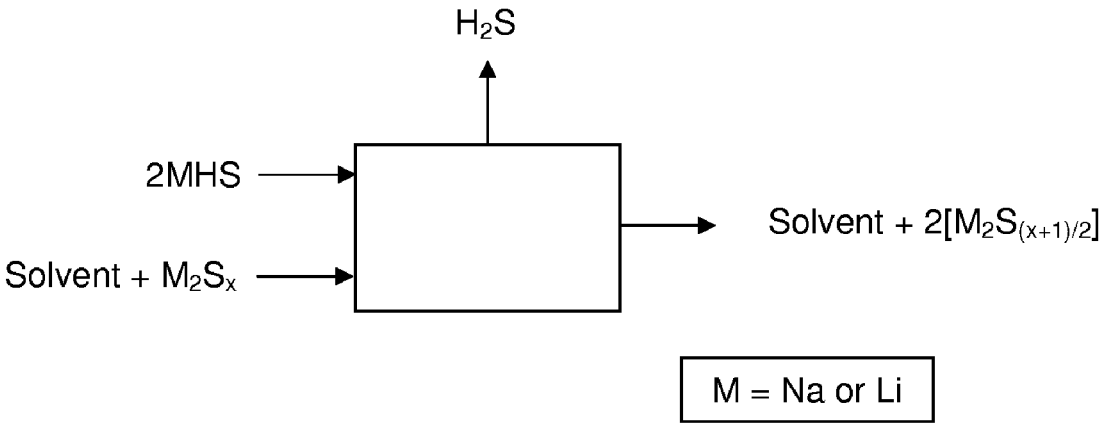
FIGS. 2A and 2B show schematic processes for converting alkali metal hydrosulfide to alkali metal polysulfide and recovering hydrogen sulfide.

A schematic representation of this process is shown in FIG. 2A. For example, in the case of sodium the following reaction may occur:

$$Na_2S_x+2NaHS \rightarrow H_2S+2[Na_2S_{(x+1)/2}]$$

Where x:y represent the average ratio of sodium to sulfur atoms in the solution. In the process shown in FIG. 2A, an alkali polysulfide with high sulfur content is converted to an alkali polysulfide with a lower sulfur content.

Figure 2B:
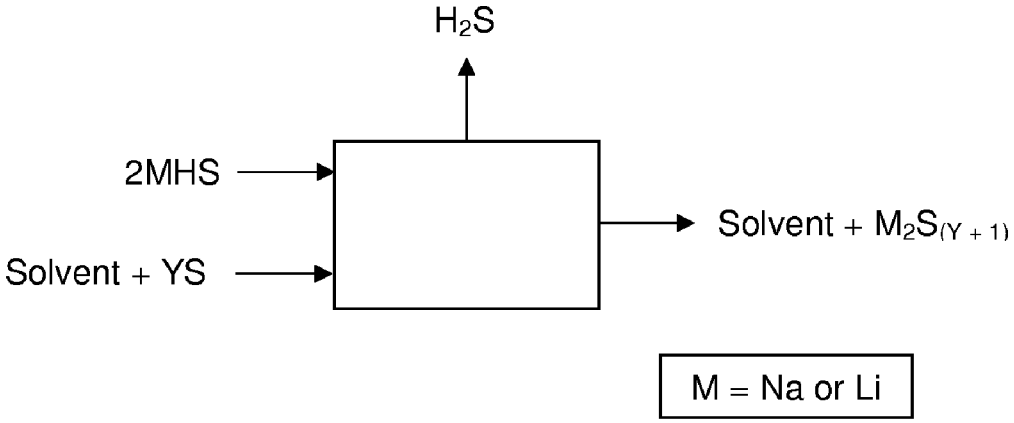

Alternatively, rather than reacting the alkali metal hydrosulfide with an alkali metal polysulfide, the alkali metal hydrosulfide can be reacted with sulfur. A schematic representation of this process is shown in FIG. 2B. For example, in the case of sodium the following reaction may occur:

$$YS+2NaHS \rightarrow H_2S+Na_2S_{(Y+1)}$$

Where Y is a molar amount of sulfur added to the sodium hydrosulfide.

The alkali metal polysulfide may be further processed in an electrolytic cell to remove and recover sulfur and to remove and recover the alkali metal. One electrolytic cell 120 is shown in FIG. 1. The electrolytic cell 120 receives alkali polysulfide 122. Under the influence of a source electric power 124, alkali metal ions are reduced to form the alkali metal (M) 126, which may be recovered and used as a source of alkali metal 106. Sulfur 128 is also recovered from the process of the electrolytic cell 120. A detailed discussion of one possible electrolytic cell that may be used in the process within the scope of the present invention is given with respect to FIG. 3. A more detailed discussion relating to the recovery of sulfur 128 is given with respect to FIG. 4, below.

Figure 4:
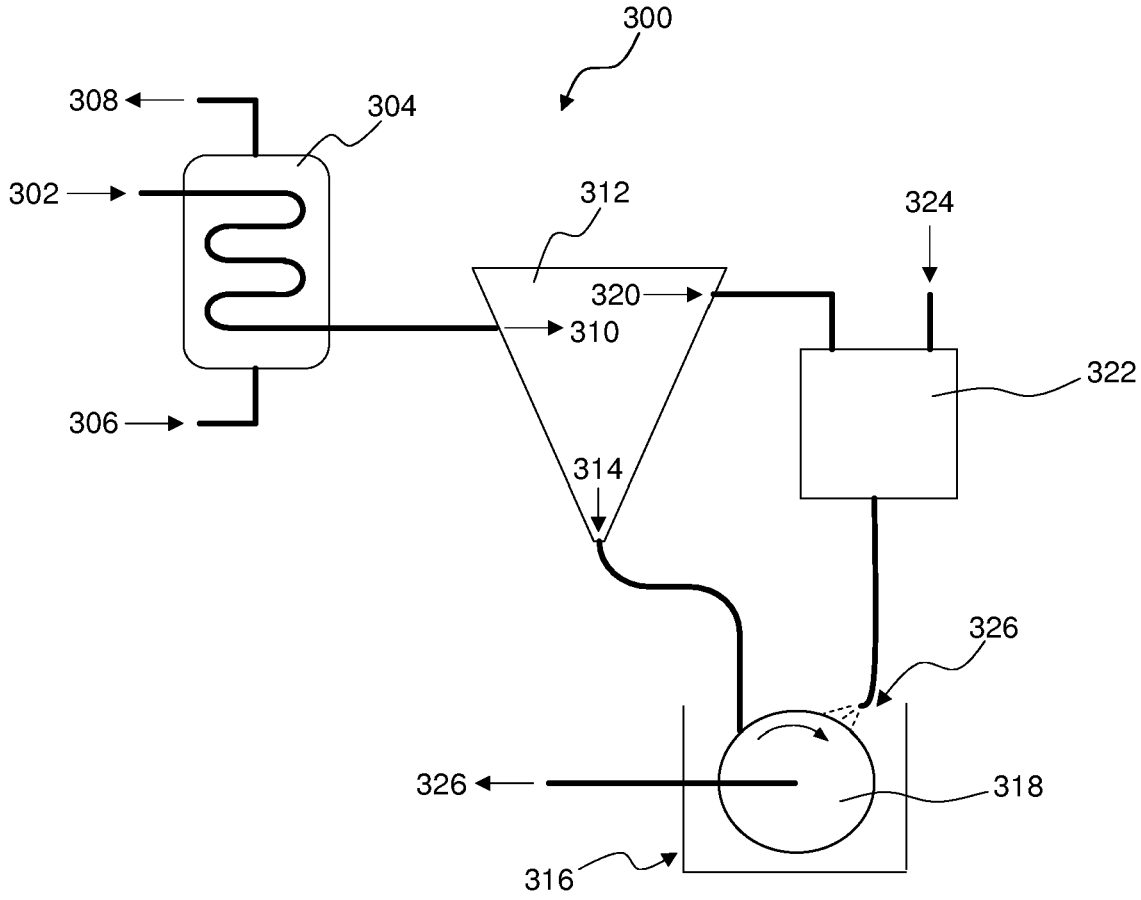
FIG. 4 shows a schematic of an apparatus which can process electrolytic cell anolyte to extract sulfur.

The vessel where the reaction depicted in FIGS. 2A and 2B occurs could be the anolyte compartment of the electrolytic cell 120 depicted in FIG. 1, the thickener 312 depicted in FIG. 4, or in a separate vessel conducive to capturing and recovering the hydrogen sulfide gas 110 generated. Alternatively, sulfur generated in the process depicted in FIG. 1 could be used as an input as depicted in FIG. 2B.

Figure 3:
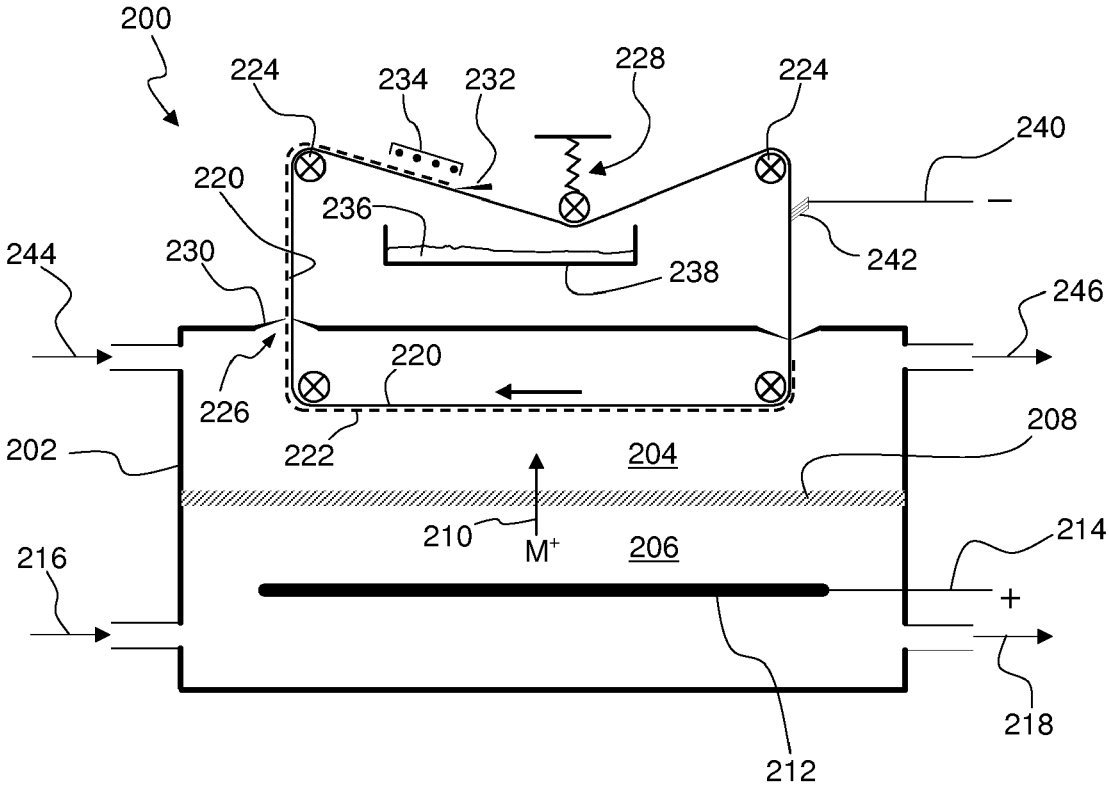
FIG. 3 shows a schematic cross-section of an electrolytic cell which utilizes many of the features within the scope of the invention.

FIG. 3 shows a schematic cross-section of an electrolytic cell 200 which utilizes many of the features within the scope of the invention. Referring to FIG. 3, electrolytic cell housing 202 is constructed to enclose a liquid solvent mixture. The material of construction preferably is an electrically insulative material such as most polymers. The material also is preferably chemically resistant to solvents. Polytetrafluoroethylene (PTFE) is particularly suitable, as well as Kynar® polyvinylidene fluoride, or high density polyethylene (HDPE). The cell housing 202 may also be fabricated from a non insulative material and non-chemically resistant materials, provided the interior of the housing 202 is lined with such an insulative and chemically resistant material. Other suitable materials would be inorganic materials such as alumina, silica, alumino-silicate and other insulative refractory or ceramic materials.

The internal space of housing 202 is divided into a catholyte compartment 204 and anolyte compartment 206 by a divider 208. The divider 208 preferably is substantially permeable only to cations and substantially impermeable to anions, polyanions, and dissolved sulfur. The divider 208 may be fabricated in part from an alkali metal ion conductive material. If the metal to be recovered by the cell is sodium, a particularly well suited material for the divider is known as NaSICON which has relatively high ionic conductivity at room temperature. A typical NaSICON composition substantially would be $Na_{1+x}Zr_2Si_xP_{3-x}O_{12}$ where $0<x<3$. Other NaSICON compositions are known in the art. Alternatively, if the metal to be recovered in the cell is lithium, then a particularly well suited material for the divider would be lithium titanium phosphate (LTP) with a composition that is substantially, $Li_{(1+x+4y)}Al_xTi_{(1-x-y)}(PO_4)_3$ where $0<x<0.4$, $0<y<0.2$. Other suitable materials may be from the ionically conductive glass and glass ceramic families such as the general composition $Li_{1+x}Al_xGe_{2-x}PO_4$. Other lithium conductive materials are known in the art. The divider 208 may have a portion of its thickness which has negligible through porosity such that liquids in the anolyte compartment 206 and catholyte compartment 204 cannot pass from one compartment to the other but substantially only alkali ions ($M^+$) 210, such as sodium ions or lithium ions, can pass from the anolyte compartment 206 to the catholyte compartment 204. The divider may also be comprised in part by an alkali metal conductive glass-ceramic such as the materials produced by Ohara Glass of Japan.

The anode 212 is located within the anolyte compartment 206. It may be fabricated from an electrically conductive material such as stainless steel, nickel, iron, iron alloys, nickel alloys, and other anode materials known in the art. The anode 212 is connected 214 to the positive terminal of a direct current power supply. The anode 212 may be a mesh, monolithic structure or may be a monolith with features to allow passage of anolyte through the anode structure. Anolyte solution is fed into the anolyte compartment through an inlet 216 and passes out of the compartment through and outlet 218. The electrolytic cell 200 can also be operated in a semi-continuous fashion where the anolyte compartment is fed and partially drained through the same passage.

The electronically conductive cathode 220 is in the form of a strip or band that has a portion within the catholyte compartment 204 and a portion outside the catholyte compartment 204 and cell housing 202, such that the alkali metal 222 can plate onto the cathode 220 while it is in the catholyte compartment 204. The alkali metal 222 can be stripped off the cathode while it is outside the catholyte compartment. Rotating rollers 224 can define the path of the cathode 220 where the path passes near the divider 208 in the catholyte compartment 204, exits the housing 202, passes through a section where the alkali metal is removed from the cathode band 220, then re-enters the housing and returns near the divider 208. One or more of the rollers may be driven by a motor or driving mechanism (not shown) to cause the cathode 220 to move through an opening 226 in the housing 202 and pass out of the housing continuously, semi-continuously or periodically.

One or more of the rollers may be attached to tensioning devices 228 to allow the cathode 220 to remain at an acceptable level of tension as the cathode band expands or contracts with temperature fluctuations and strains from stress. Wiping seals 230 remove catholyte solution from the cathode 220 as it egresses the cell so that the catholyte is returned back to the catholyte compartment. The cathode band may be fabricated from steel, flexible metal alloys, and other conductive materials suitable for its intended purpose. A scraper 232 can be used to remove the plated alkali metal 222 from the cathode 220 as it moves. Alternatively, the cathode may be exposed to a heated zone 234 that melts the alkali metal off of the cathode 220. The removed alkali metal 236 may fall into a container 238 which may have a conveyance system (not shown) to transfer the alkali metal 236 away from the cell 200 to a storage area or point of use.

The cathode 220 is polarized by a connection 240 to the negative terminal of a power supply. This connection may be made with an electronically conductive brush 242 that contacts the cathode 220 or it may be made through one or more of the rollers 224 contacting the cathode belt. The catholyte compartment 204 may have an inlet port 244 and an outlet port 246 to transfer catholyte solution in and out of the catholyte compartment 204 when required.

Within the catholyte compartment is an alkali ion conductive liquid which may include a polar solvent. Non-limiting examples of suitable polar solvents are tetraglyme, diglyme, dimethyl carbonate, dimethoxy ether, propylene carbonate, ethylene carbonate, diethyl carbonate and such. An appropriate alkali metal salt, such as a chloride, bromide, iodide, perchlorate, hexafluorophosphate or such, is dissolved in the polar solvent to form that catholyte solution.

One non-limiting example of the operation of the electrolytic cell 200 is described as follows: Anolyte solution containing approximately 60-100% polar solvent such as tetraethylene glycol dimethyl ether (tetraglyme, TG), and 0-40% apolar solvent such as N,N-dimethylaniline (DMA) or quinoline, and 1% to saturation, sodium polysulfide relative to the total solvent, is fed into the anode compartment 206. The electrodes are energized such that there is an electrical potential between the anode 212 and the cathode 220 that is greater than the decomposition voltage which ranges between about 1.8V and about 2.5V depending on the composition. Concurrently, sodium ions pass through the divider into the cathode compartment 204, sodium ions are reduced to the metallic state and plate onto the cathode belt 220, and polysulfide is oxidized at the anode such that low polysulfide anions become high polysulfide anions and/or elemental sulfur forms at the anode. While sulfur is formed it is dissolved into the anolyte solvent in entirety or in part.

The sodium plated onto the belt is removed from the cell as the cathode belt is advanced then subsequently the alkali metal 222 is removed from the cathode belt 220 by scraping or melting outside of the cell. The catholyte is comprised of a polar solvent such as tetraglyme and a salt to increase the ionic conductivity. For example, in this case sodium halide salt such as sodium chloride can be used to increase the ionic conductivity and the decomposition voltage of sodium chloride is much higher than the decomposition of sodium polysulfide. The electrolytic cell 200 is operated at a temperature below the melting temperature of sodium. To minimize cell heating due to resistive losses, the anode and cathode are spaced relatively close to the divider 208, within a few millimeters. Adjustments to cell temperature can be made using a heat exchanger on the flow of anolyte entering and exiting the cell through ports 216, 218.

The cell shown in FIG. 3 has a general horizontal orientation but could also be configured in a generally vertical or other orientation.

In the case of the alkali metal being sodium, the following typical reactions may occur in the electrolytic cell 200:

At the Cathode:

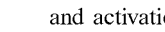

$$Na^{+}+e^{-}\rightarrow Na$$

At the Anode:

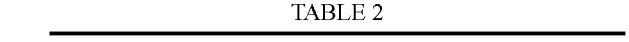

$$Na_2S_x\rightarrow Na^{+}+e^{-}+\tfrac{1}{2}Na_2S_{(2x)} \quad 1)$$

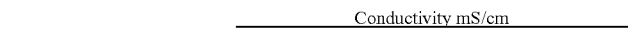

$$Na_2S_x\rightarrow Na^{+}+e^{-}+\tfrac{1}{2}Na_2S_x+x/16S_g \quad 2)$$

Where x ranges from 0 to about 8.

Most sodium is produced commercially from electrolysis of sodium chloride in molten salt rather than sodium polysulfide, but the decomposition voltage and energy requirement is about half for polysulfide compared to chloride as shown in Table 1.

TABLE 1

Decomposition voltage and energy (watt-hour/mole) of sodium and lithium chlorides and sulfides

| | NaCl | $Na_2S$ | LiCl | $Li_2S$ |
|---|---|---|---|---|
| V | 4.0 | <2.1 | 4.2 | 2.3 |
| Wh/mole | 107 | <56 | 114 | 60 |

The open circuit potential of a sodium/polysulfide cell is as low as 1.8V when a lower polysulfide, $Na_2S_3$ is decomposed, while the voltage rises with rising sulfur content. Thus, it may be desirable to operate a portion of the electrolysis using anolyte with lower sulfur content. In one embodiment, a planar NaSICON or Lithium Titanium Phosphate (LTP) membrane is used to regenerate sodium or lithium, respectively. NaSICON and LTP have good low temperature conductivity as shown in Table 2. The conductivity values for beta alumina were estimated from the 300° C. conductivity and activation energy reported by May. G. May, *J. Power Sources,* 3, 1 (1978).

TABLE 2

Conductivities of NaSICON, LTP, Beta alumina at 25° C., 120° C.

| | Conductivity mS/cm | | |
|---|---|---|---|
| Temperature ° C. | NaSICON | LTP | Beta alumina (est) |
| 25 | 0.9 | 0.9 | 0.7 |
| 120 | 6.2 | 1.5 | 7.9 |

The anolyte solution is preferably selected to dissolve polysulfides and sulfur. Hwang et al. disclosed in their lithium sulfur battery patent U.S. Pat. No. 6,852,450 a high cathode (sulfur electrode) utilization by using a mixture of polar and apolar solvents. The polar solvents were useful for dissolving most of the polysulfides that are polar in nature and the apolar solvent is useful for dissolving the sulfur that is apolar in nature. A mixture of polar and apolar solvents may be used in anolyte solution within the scope of the present invention, but it is not required. If the electrolytic cells are operated above the melting temperature of sulfur, it may not be necessary to use an apolar solvent for the purposes of completely dissolving the sulfur, but the apolar solvent will likely reduce the polarization of the anode. Hwang measured the solubility of sulfur and found numerous solvents with relatively high solubility. Hwang did not report the solubility of polysulfides. The top eight solvents were cyclohexane, benzene, trifluortoluene, toluene, fluorbenzene, tetrahydrofurane (THF) and 2-methyl tetrahydrofurane (2-MeTHF). The first six have solubilities above 80 mM while the last two have solubilities above 40 mM. To separate the sulfur, a portion of the anolyte from the high polysulfide cells will be bled off and processed, as discussed below. Some of the sulfur may be removed by cooling and gravimetrically separating or through filtration. Other methods may also be used such as vaporizating the apolar solvent then using gravimetric or filtration means.

Table 3 lists the eight solvents with highest sulfur solubility based on Hwang et al. Hwang did not specify but the solubilities listed are probably for temperatures near 25° C. and would be higher at elevated temperatures. The table also lists the boiling points of those solvents. The data is arranged in order of boiling point temperature. Based on this data, the most suitable solvents to be added to the anolyte are xylene, toluene and trifluorotoluene. Operation at pressures above ambient may be desirable to keep the solvent from vaporizing at operating temperatures near 120° C., particularly since most of the domestic shale oil would be processed at elevations between 4000-8000 feet.

TABLE 3

Sulfur solubility and boiling point of eight solvents, high solubility

| Solvent | Sulfur Solubility (mM) | Boiling Point (° C.) |
|---|---|---|
| Xylene | 77 | 140 |
| Toluene | 84 | 111 |
| Trifluorotoluene | 78 | 103 |
| Fluorobenzene | 83 | 85 |
| Cyclohexane | 93 | 81 |
| Benzene | 88 | 80 |
| 2-Me THF | 44 | 80 |
| THF | 48 | 66 |

Conversely, Table 4 lists eight solvents with low sulfur solubility based on Hwang et al. Composing anolyte from one or more solvents from Table 3 and one or more solvents from Table 4 may be desirable such that apolar solvent dissolves sulfur and a polar solvent dissolves the polar polysulfide. If the process is run in stages, it may be useful to have the apolar solvent in the low polysulfide cells because there should be negligible free sulfur. Based on boiling point in Table 4, tetraglyme, and diglyme would be the best candidate solvents for the anolyte, given operating temperature of 120° C.

TABLE 4

Sulfur solubility and boiling point of eight solvents, low solubility

| Solvent | Sulfur Solubility (mM) | Boiling Point (° C.) |
|---|---|---|
| Tetraglyme | 1.4 | 275 |
| Diglyme | 1.5 | 162 |
| Isopropanol | 1.0 | 108 |
| Ethyl Propianal | 1.7 | 99 |
| Dimethyl Carbonate | 0.8 | 90 |
| Dimethoxy ether | 1.3 | 85 |
| Ethanol | 0.9 | 78 |
| Ethyl acetate | 1.5 | 77 |

Sulfur has been found to be soluble to an extent in tetraglyme and the solubility rises with increasing temperature. Adding an apolar solvent such as N,N-dimethylaniline (DMA) increases the sulfur solubility. The sulfur solubilities versus temperature for tetraglyme, DMA and mixture of tetraglyme and DMA, 80:20 by weight are shown in Table 3 below:

TABLE 3

Sulfur solubility in solvents versus temperature (wt %)

| Temp ° C. | TG | DMA | 80:20 TG:DMA |
|---|---|---|---|
| 25 | 0.16 | 3.37 | 0.46 |
| 50 | 1.01 | 6.92 | 1.26 |
| 70 | 1.16 | 10.7 | 1.89 |

Tetraglyme alone can dissolve sulfur formed at the anode to an extent, particularly if the cells operate at elevated temperatures above 50° C. Addition of selected solvents such as DMA enables the solvent to dissolve more sulfur, preventing polarization at the anode.

If the electrolytic cells operate at an even slightly elevated temperature of about 70° C., a stream of anolyte solution near saturation can be brought outside the electrolytic cell and chilled using a heat exchanger or other means to cause sulfur to precipitate. The sulfur can be removed by one of several means such as filtration, gravimetrically, centrifugation, and such. Sulfur has nearly 2 times the specific gravity of the solvent mixture and is easily separated. The sulfur depleted solvent then can be returned to the anolyte to reduce the overall sulfur concentration in the anolyte.

A system 300 to remove sulfur from the anolyte solution is disclosed schematically in FIG. 4. Referring to FIG. 4, warm sulfur laden anolyte solution 302 enters heat exchanger 304. Coolant 306 from a chiller or cooling tower (not shown) cool down the anolyte through heat exchange. Coolant from the heat exchanger 308 returns back to the chiller. As the sulfur laden anolyte solution 302 is cooled, sulfur precipitates. The chilled anolyte 310 enters an enclosed thickener 312 to allow settling of solid phase sulfur. A stream heavily containing sulfur solids 314 flows to a rotary filter 316. Liquid anolyte flows into the filter while solid sulfur remains on the filter media on the outside of the drum 318. Overflow anolyte from the thickener 320 enters a tank 322 that also receives make-up solvent mixture 324. Together this stream is used as a spray 326 to wash the sulfur filter cake. The sulfur filter cake is removed from the rotary filter enclosure by a conveyor means (not shown). Chilled and low sulfur bearing anolyte 326 is pumped from the filter drum back to the electrolytic cell. The stream 326 may be heat exchanged with stream 302 in a heat exchanger (not shown) to heat up the anolyte before returning it to the electrolytic cell and to reduce the temperature of the anolyte entering the chilled heat exchanger 304. It will be appreciated that many alternative approaches and variations to this process of removing sulfur from the anolyte solution are possible.

Other anolyte solvents which may be utilized to increase sulfur solubility in the anolyte solution include: tetrahydrofuran, 2-methyl tetrahydrofuran, benzene, cyclohexane, fluorobenzene, thrifluorobenzene, toluene and xylene. Other polar solvents which may be used to dissolve polysulfides include: tetraglyme, diglyme, isopropanol, ethyl propional, dimethyl carbonate, dimethoxy ether, ethanol and ethyl acetate, propylene carbonate, ethylene carbonate, diethyl carbonate and such.

Another non-limiting example on a process within the scope of the present invention is like the one disclosed above except lithium polysulfide is decomposed. Lithium ions pass through the divider and lithium metal is reduced at the cathode inside the cell and scraped off outside the cell.

It is understood that makeup constituents to the process can be added in many different places without deviating from the invention. For example, makeup alkali metal sulfide or polysulfide may be added directly to the electrolytic cell or to the sulfur removal stream or an ancillary mixing chamber. In addition, an alkali hydrosulfide could be added to the anolyte stream somewhere in the process, preferably at a location where it is convenient to collect the evolving hydrogen sulfide so it can be reused in another process.

It is also understood that while one preferred mode of the invention is where the cathode is as described above, with part of the cathode within the cell and part of the cathode outside the cell, the electrolytic cell may also be designed to operate in a batch mode where the cathode is periodically removed from the cell and the alkali metal is stripped from the cathode or in the case where the temperature is above the melting temperature of the alkali metal, the metal may be removed through suction or gravity flow though tubes or other passages.

It may be beneficial to operate 2 or more sets of cells. Some cells would operate with lower order polysufides in the anolyte while another set of cells operate with higher order polysulfide. In the latter, free sulfur would become a product requiring removal.

The following example is provided below which discusses one specific embodiment within the scope of the invention. This embodiment is exemplary in nature and should not be construed to limit the scope of the invention in any way.

An electrolytic flow cell utilizes a 1" diameter NaSICON membrane with approximately 3.2 $cm^2$ active area. The NaSICON is sealed to a scaffold comprised of a non-conductive material that is also tolerant of the environment. One suitable scaffold material is alumina. Glass may be used as the seal material. The flow path of electrolytes will be through a gap between electrodes and the membrane. The anode (sulfur electrode) may be comprised of aluminum. The cathode may be either aluminum or stainless steel. It is within the scope of the invention to configure the flow cell with a bipolar electrodes design. Anolyte and catholyte solutions will each have a reservoir and pump. The anolyte reservoir will have an agitator. The entire system will preferably have temperature control with a maximum temperature of 150° C. and also be configured to be bathed in a dry cover gas. The system preferably will also have a power supply capable of delivering to 5 VDC and up to 100 $mA/cm^2$.

As much as possible, materials will be selected for construction that are corrosion resistant with the expected conditions. The flow cell will be designed such that the gap between electrodes and membrane can be varied.

In view of the foregoing, it will be appreciated that the disclosed invention includes one or more of the following advantages:

Operating an electrolytic cell to process an alkali metal sulfide or polysulfide at temperatures below the melting temperature of the alkali metal.

Operating an electrolytic cell continuously or semi-continuously to process an alkali metal sulfide or polysulfide at temperatures below the melting temperature of the alkali metal.

Removing an alkali metal continuously or semi-continuously in solid form from the cell.

Removing high alkali metal polysulfides and dissolved sulfur continuously or semi-continuously from the electrolytic cell, thereby reducing polarization of the anode by sulfur.

Separating sulfur continuously or semi-continuously from a stream containing a mixture of solvent, sulfur, and alkali metal polysulfides such that the solvent and alkali metal polysulfides are substantially recovered such that they can be returned back to an electrolytic process.

Providing an apparatus and method for regenerating hydrogen sulfide from and alkali metal hydrosulfide.

Operating the electrolytic cells at low temperatures and pressures, so that the electrolytic cell materials of construction can include materials which would not tolerate elevated temperature.

While specific embodiments of the present invention have been illustrated and described, numerous modifications come to mind without significantly departing from the spirit of the invention, and the scope of protection is only limited by the scope of the accompanying claims.

The invention claimed is:

1. A process for oxidizing alkali metal polysulfides electrochemically comprising:

obtaining an electrolytic cell comprising an alkali ion conductive membrane configured to selectively transport alkali ions, the membrane separating an anolyte compartment configured with an anode and a catholyte compartment configured with a cathode;

introducing into the anolyte compartment an anolyte solution comprising an alkali metal polysulfide and an anolyte solvent that dissolves elemental sulfur;

introducing into the catholyte compartment a catholyte;

applying an electric current to the electrolytic cell thereby:

i. oxidizing sulfur in the anolyte compartment to form elemental sulfur;

ii. causing alkali metal ions to pass through the alkali ion conductive membrane from the anolyte compartment to the catholyte compartment; and iii. reducing the alkali metal ions in the catholyte compartment to form elemental alkali metal;

removing at least a portion of the anolyte solution from the anolyte compartment and cooling the removed anolyte solution to precipitate solid phase sulfur from the anolyte solution.

2. The process according to claim 1, wherein the alkali ion conductive membrane is substantially impermeable to anions, the catholyte solvent, the anolyte solvent, and dissolved sulfur.

3. The process according to claim 1, wherein the alkali ion conductive membrane comprises in part an alkali metal conductive ceramic or glass ceramic.

4. The process according to claim 1, wherein the alkali ion conductive membrane comprises a solid MSICON (Metal Super Ion CONducting) material, where M is Na or Li.

5. The process according to claim 1, wherein the anolyte solvent has a sulfur solubility at 70° C. that is two or more times the solubility of the solvent at 25° C.

6. The process according to claim 1, wherein the anolyte solvent comprises one or more solvents selected from N,N-dimethylaniline, quinoline, tetrahydrofuran, 2-methyl tetrahydrofuran, benzene, cyclohexane, fluorobenzene, thrifluorobenzene, toluene, xylene, tetraethylene glycol dimethyl ether (tetraglyme), diglyme, isopropanol, ethyl propional, dimethyl carbonate, dimethoxy ether, ethanol and ethyl acetate, propylene carbonate, ethylene carbonate, and diethyl carbonate.

7. The process according to claim 1, wherein the anolyte solvent comprises from about 60-100 vol. % polar solvent and 0-40 vol. % apolar solvent.

8. The process according to claim 1, wherein the anolyte solvent comprises tetraethylene glycol dimethyl ether (tetraglyme).

9. The process according to claim 1, further comprising the step of separating solid phase sulfur from the anolyte solution.

10. The process according to claim 1, wherein the separation of solid phase sulfur includes one or more of the separation techniques: gravimetric, filtration, or centrifugation.

11. The process according to claim 1, wherein the electrolytic cell operates at a temperature below the melting temperature of the alkali metal such that the alkali metal plates onto the cathode.

12. The process according to claim 11, wherein the cathode in part is in contact with the catholyte solution within the catholyte compartment and the cathode in part is outside the catholyte compartment.

13. The process according to claim 12, wherein the cathode within the catholyte compartment can be transferred outside the catholyte compartment and the cathode outside the catholyte compartment can be transferred inside the catholyte compartment without substantially interrupting the electrolytic cell operation.

14. The process according to claim 12, wherein the cathode consists of a metal band following the path of rollers which facilitate the transfer of cathode inside and outside of the catholyte compartment.

15. The process according to claim 12, wherein the alkali metal plates onto the cathode when it is inside the catholyte compartment and is removed from the cathode when it is outside the catholyte compartment.

16. The process according to claim 1, wherein the catholyte comprises a solution comprising alkali metal ions and a catholyte solvent.

17. The process according to claim 16, wherein the catholyte solvent comprises a polar solvent selected from tetraglyme, diglyme, dimethyl carbonate, dimethoxy ether, propylene carbonate, ethylene carbonate, and diethyl carbonate.

18. The process according to claim 16, wherein the alkali metal ions in the catholyte solution are derived from an alkali metal salt selected from an alkali metal chloride, bromide, iodide, perchlorate, and hexafluorophosphate.

19. The process according to claim 16, wherein the alkali metal ions in the catholyte compartment are reduced to form elemental alkali metal at a temperature below the melting temperature of the alkali metal.

20. The process according to claim 1, wherein the catholyte comprises a molten alkali metal.

21. An electrolytic cell for oxidizing alkali metal polysulfides comprising:

an anolyte compartment configured with an anode and containing an anolyte solution comprising an alkali polysulfide and a solvent that dissolves elemental sulfur;

a catholyte compartment configured with a cathode and containing a catholyte;

an alkali ion conductive membrane configured to selectively transport alkali ions, wherein the alkali ion conductive membrane is substantially impermeable to anions, the catholyte solvent, the anolyte solvent, and dissolved sulfur; and a source of electric potential electrically coupled to the anode and the cathode.

22. The electrolytic cell according to claim 21, wherein the alkali ion conductive membrane comprises in part an alkali metal conductive ceramic or glass ceramic.

23. The electrolytic cell according to claim 21, wherein the alkali ion conductive membrane comprises a solid MSICON (Metal Super Ion CONducting) material, where M is Na or Li.

24. The electrolytic cell according to claim 21, wherein the anolyte solvent has a sulfur solubility at 70° C. that is two or more times the solubility of the solvent at 25° C.

25. The electrolytic cell according to claim 21, wherein the anolyte solvent comprises one or more solvents selected from N,N-dimethylaniline, quinoline, tetrahydrofuran, 2-methyl tetrahydrofuran, benzene, cyclohexane, fluorobenzene, thrifluorobenzene, toluene, xylene, tetraethylene glycol dimethyl ether (tetraglyme), diglyme, isopropanol, ethyl propional, dimethyl carbonate, dimethoxy ether, ethanol and ethyl acetate, propylene carbonate, ethylene carbonate, and diethyl carbonate.

26. The electrolytic cell according to claim 21, wherein the anolyte solvent comprises from about 60-100 vol. % polar solvent and 0-40 vol. % apolar solvent.

27. The electrolytic cell according to claim 21, wherein the anolyte solvent comprises tetraethylene glycol dimethyl ether (tetraglyme).

28. The electrolytic cell according to claim 21, wherein the electrolytic cell is configured to operate at a temperature below the melting temperature of the alkali metal and where the catholyte comprises a solution comprising an alkali salt and a catholyte solvent.

29. The electrolytic cell according to claim 28, wherein the catholyte solvent comprises a polar solvent selected from tetraglyme, diglyme, dimethyl carbonate, dimethoxy ether, propylene carbonate, ethylene carbonate, and diethyl carbonate.

30. The electrolytic cell according to claim 21, where the catholyte comprises molten alkali metal.

* * * * *

UNITED STATES PATENT AND TRADEMARK OFFICE

CERTIFICATE OF CORRECTION

PATENT NO. : 8,088,270 B2
APPLICATION NO. : 12/277822
DATED : January 3, 2012
INVENTOR(S) : Gordon et al.

It is certified that error appears in the above-identified patent and that said Letters Patent is hereby corrected as shown below:

In the Specification

Add the following immediately after the title in Column 1, line 4:

"U.S. GOVERNMENT INTEREST

This invention was made with government support under Contract No. DE-FE0000408 awarded by the Department of Energy. The Government has certain rights in this invention."

Signed and Sealed this
Fourteenth Day of April, 2015

Michelle K. Lee

Michelle K. Lee
*Director of the United States Patent and Trademark Office*